United States Patent [19]

Kusabuka

[11] Patent Number: 5,026,185

[45] Date of Patent: Jun. 25, 1991

[54] PRINTER WITH ADJUSTABLE PRESSING PLATE

[75] Inventor: Yoshito Kusabuka, Suwa, Japan

[73] Assignee: Seiko Epson Corporation, Tokyo, Japan

[21] Appl. No.: 171,491

[22] Filed: Mar. 18, 1988

[30] Foreign Application Priority Data

| | | | |
|---|---|---|---|
| Mar. 23, 1987 | [JP] | Japan | 62-68347 |
| Mar. 31, 1987 | [JP] | Japan | 62-79451 |
| Mar. 31, 1987 | [JP] | Japan | 62-79452 |

[51] Int. Cl.[5] ..... B41J 11/20

[52] U.S. Cl. ..... 400/618; 400/637

[58] Field of Search ..... 400/618, 637, 642, 647, 400/647.1, 680, 689, 690, 690.1, 690.2, 690.3, 690.4, 691, 693

[56] References Cited

U.S. PATENT DOCUMENTS

| | | | |
|---|---|---|---|
| 1,547,326 | 7/1925 | Hokanson | 400/637.6 |
| 1,851,049 | 3/1932 | Lear | 400/637.5 |
| 3,334,722 | 8/1967 | Bernard | 400/618 X |
| 4,014,426 | 3/1977 | Neufeld | 186/133 R |
| 4,114,750 | 9/1978 | Baeck et al. | 400/618 X |
| 4,167,346 | 9/1979 | Holland-Letz | 400/618 |
| 4,294,556 | 10/1981 | Rix | 400/643 |
| 4,357,060 | 11/1982 | Kuhn | 312/351 |
| 4,437,780 | 3/1984 | Weber et al. | 400/642 |
| 4,497,588 | 2/1985 | Volke et al. | 400/645.1 |
| 4,507,102 | 3/1985 | Geis et al. | 474/101 |
| 4,514,740 | 4/1985 | Fujiwara et al. | 346/139 R |
| 4,526,489 | 7/1985 | Tsumuraya et al. | 400/618 X |
| 4,586,839 | 5/1986 | Iwagami | 400/691 X |
| 4,611,939 | 9/1986 | Fujiwara | 400/637 |
| 4,668,960 | 5/1987 | Okamura | 400/642 X |
| 4,813,800 | 3/1989 | Hasegawa et al. | 400/618 X |

FOREIGN PATENT DOCUMENTS

| | | | |
|---|---|---|---|
| 0058902 | 9/1982 | European Pat. Off. | 400/618 |
| 0118318 | 12/1984 | European Pat. Off. . | |
| 3009001 | 9/1981 | Fed. Rep. of Germany | 400/690.1 |
| 2557507 | 7/1985 | France . | |
| 0188468 | 10/1984 | Japan | 400/637 |
| 0198172 | 11/1984 | Japan | 400/642 |
| 0073879 | 4/1985 | Japan | 400/689 |
| 0073880 | 4/1985 | Japan | 400/689 |
| 0073881 | 4/1985 | Japan | 400/689 |
| 165276 | 8/1985 | Japan . | |
| 0220774 | 11/1985 | Japan | 400/637 |
| 61-12367 | 1/1986 | Japan . | |
| 0020781 | 1/1986 | Japan | 400/642 |
| 0138268 | 6/1987 | Japan | 400/637 |
| 0270358 | 11/1987 | Japan | 400/618 |
| 0270359 | 11/1987 | Japan | 400/618 |
| 0270360 | 11/1987 | Japan | 400/618 |
| 2161758 | 1/1986 | United Kingdom . | |

OTHER PUBLICATIONS

IBM Technical Disclosure Bulletin, "Paper Clamp with Electromagnet for an Endless Form Printer with Revolving Type Set", Abendschein et al., vol. 25, No. 2, Jul. 1982, p. 636.

IBM Technical Disclosure Bulletin, "Forms Tension Mechanism", vol. 29, No. 3, Aug. 1986, pp. 1112–1113.

"Cut Forms Feed Gate" by J. N. Cassell and T. F. Shelton, IBM Technical Disclosure Bulletin, vol. 23, No. 3, Aug. 1980, pp. 903–904.

IBM Technical Disclosure Bulletin, vol. 23, No. 9, Feb. 1981, pp. 3965–3966.

*Primary Examiner*—Edgar S. Burr

*Assistant Examiner*—Joseph R. Keating

*Attorney, Agent, or Firm*—Blum Kaplan

[57] ABSTRACT

A printer including a cover plate with a plurality of ribs connected along the bottom surface thereof to guide that portion of a recording medium which has passed by a print head through the discharge port of the printer. A release assembly controls and is operable for varying the level of pressure exerted by a pair of plates against a platen. A guide plate formed from portions having different sloped surfaces is detachably connected through clips to a frame of the printer. The printer also includes a mechanism for automatically setting a timing belt to a predetermined constant level of tension.

12 Claims, 14 Drawing Sheets

FIG. 8
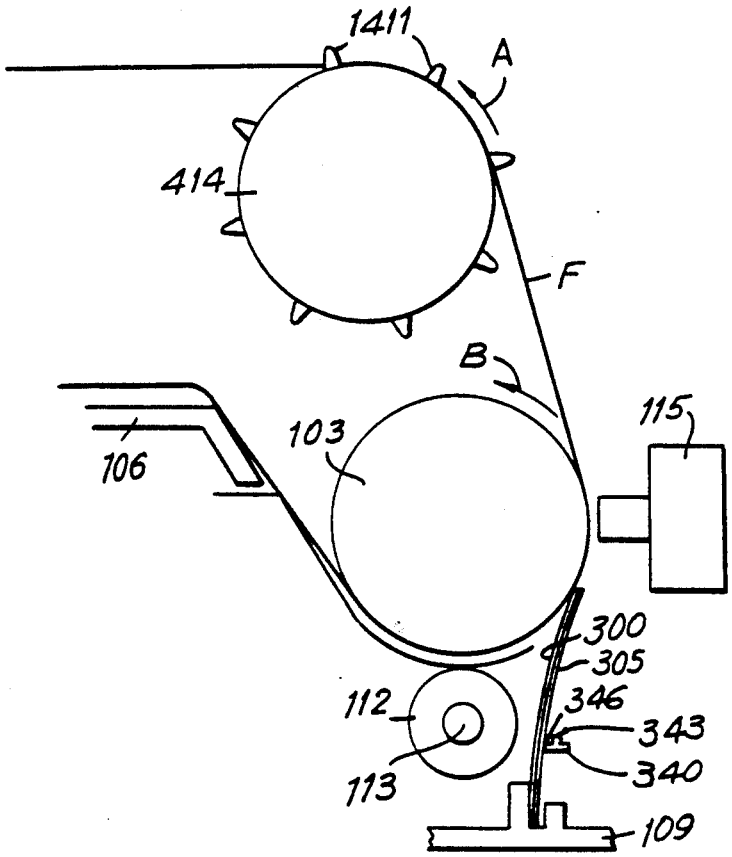
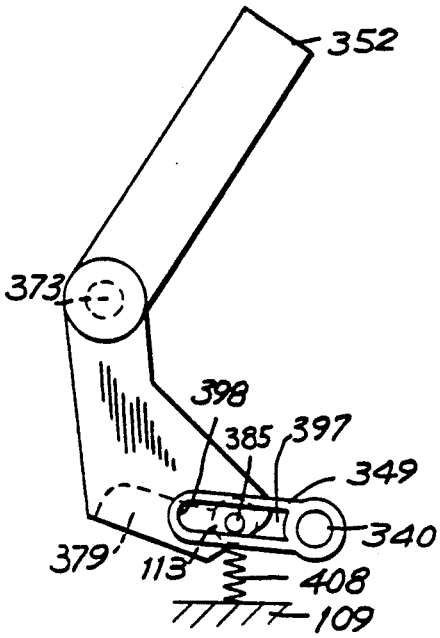
FIG. 9

FIG. 10
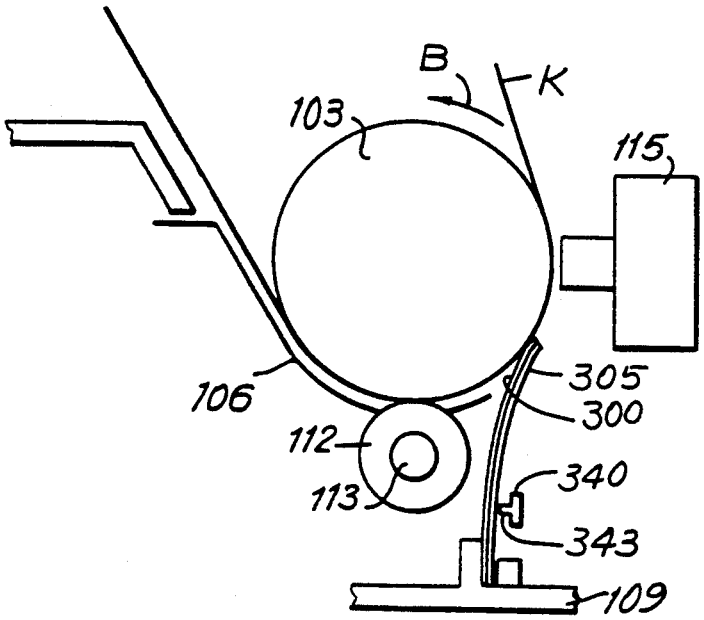
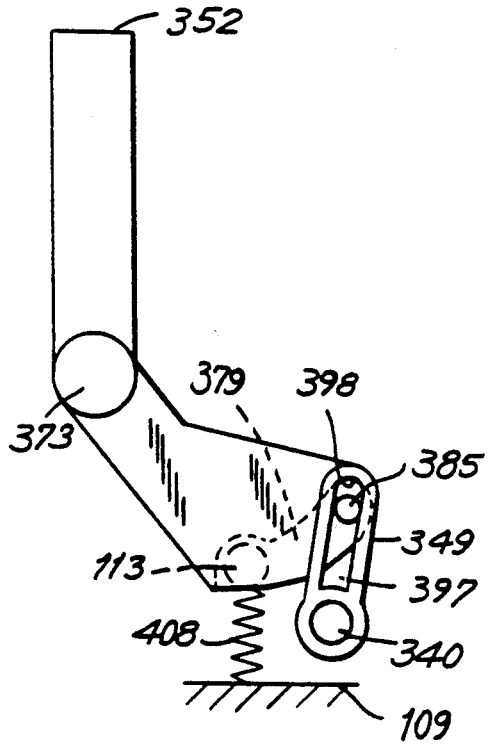
FIG. 11

PRINTER WITH ADJUSTABLE PRESSING PLATE

BACKGROUND OF THE INVENTION

This invention is directed toward a printer, and more particularly to mechanisms for feeding a recording medium through and for driving a carriage of the printer and to the construction and assembly of a frame to a frame plate of the printer.

A printer typically includes a guiding plate, pressing plate and paper bail for controlling the path of a recording medium such as a sheet of paper as the sheet of paper is advanced through the printer. The sheet of paper is initially inserted against the guiding plate which guides the sheet of paper to a position adjacent a platen. The pressing plate further directs the paper against the platen so as to properly position the paper for printing thereon. The paper bail then presses that portion of the paper which is advanced past the printing head against the platen to properly position the paper for discharge from the printer.

Assembly of the printer requires the guiding plate to be precisely positioned relative to the platen. Otherwise the paper will not be properly fed through the printer. Guiding plates made of polymer materials must be manufactured at a thickness greater than that of other materials such as, but not limited to, metals to maintain the guiding plate in a fixed position during operation of the printer. Due to the greater thickness required, guiding plates made of polymer materials are more expensive to manufacture compared to guiding plates made of metallic materials.

The pressing plate is generally made from metallic materials having relatively high frictional characteristics. Advancing the paper past the pressing plate therefore requires a driving mechanism which produces a relatively high torque. The pressure exerted by the pressing plate is maintained at a fixed level against the platen. Control in the level of pressure exerted by the pressing plate is not possible. Such lack of control is particularly troublesome when a continuous roll of paper is used. The continuous roll of paper has holes along one or both edges thereof and is advanced through the use of a sprocket or tractor. The excessive pressure exerted by the pressing plate against the continuous roll of paper inhibits the advancement of the paper by the sprocket or tractor. Accordingly, the holes in the paper become deformed. Such deformation results in the continuous roll of paper eventually being fed at an unacceptable pitch through the printer.

Operation of the paper bail is also somewhat complicated inasmuch as the bail must be kept from the platen surface until the paper has advanced between the bail and platen. Following discharge of the paper from the printer, the paper bail then must be repositioned away from the platen. In printers having a cut-paper automatic mode of operation, an automatic mechanism for opening and closing the paper bail is required which further complicates the structure of the printer.

Printing mechanisms can be clarified to include a principal scanner portion and a subsidiary scanner portion. The principal scanner portion includes the platen which defines the principal scanner portion and the paper guide. The subsidiary scanner portion includes the motor, carriage, printing head and timing belts and moves the printing head reciprocatably in the lateral direction along the paper (i.e. in directions perpendicular to the direction in which the paper advances).

The carriage on which the printing head is seated is driven in a reciprocating manner by the motor through a timing belt. Positional accuracy of the printing head is obtained by the tension provided from the timing belt. The carriage and timing belt are held in place by a frame plate which is typically made of a metallic material and is generally secured to the frame of the printer by screws to provide the mechanical strength required for reciprocating movement of the carriage and continuous rotation of the timing belt during operation of the printer. Assembly of the frame plate to the frame is often troublesome and time consuming due to the use of screws or the like required for assembly.

The motor employed in the carriage driving mechanism of a conventional printer is also fixed to one end of the frame by screws or the like. The timing belt wraps around the driving pulley which is fixed to a shaft providing the rotational output torque produced by the motor and an additional (i.e. following) pulley which is positioned near the other end of the frame. Consequently, the tension of the timing belt must be controlled by adjusting the torque (i.e. movement) of the motor or the position of the additional pulley.

It is therefore desirable to provide a printer having a guiding plate which need not be assembled within the frame of the printer with the precision demanded from commercially available printers. Guiding plates made from polymer materials should be produced at a cost at least comparable to those made from other suitable materials rather than at a higher cost. It is also desirable to provide a printer whose pressing plate exerts different levels of pressure against the recording medium.

Preferably, use of a paper bail should be avoided to simplify the structure of the printer. Assembly of the frame plate to the frame should be simple and accomplished in relatively little time. The correct tension on the timing belt should be automatically controlled to thereby eliminate the need to manually adjust the movement of the motor or position of a pulley.

SUMMARY OF THE INVENTION

Generally speaking, in accordance with the invention, the printer includes a platen and a cover having three different guiding members located near the platen. In the preferred embodiment, one or more ribs protruding from the bottom of the cover provides these three different guiding members. Each of the ribs has a first sloped surface (i.e. first guiding member) for directing the recording medium toward the platen following advancement of the recording medium beyond the printhead; a corner or vertex (i.e. second guiding member) for placing a portion of the recording medium which has advanced beyond the printhead against the platen; and a third sloped surface (i.e. third guiding member) for directing the discharge of the recording medium from the printer. The one or more ribs serve to eliminate the need for a paper bail. Therefore, the printer structure is simplified, easier to assemble and less costly to manufacture. Since there is no paper bail, there is also no longer a need to provide a special mechanism for opening and closing the paper bail.

The printer also includes a guide plate having an upper portion and a lower portion manufactured as an integral unit but which have different sloped surfaces. In the preferred embodiment, each of the sloped surfaces has a different radius of curvature.

On the rear surface of the guide plate near the boundary between the upper portion and lower portion, are a plurality of clips. Each clip has a substantially U-shaped member and a claw. The guide plate is easily and quickly assembled to the frame of the printer by pressing the U-shaped members into sliding engagement with the rear wall of the frame. The U-shaped members are dimensioned so as to ensure that the guide plate is properly positioned and separated from the platen. At the same time, the claws are slid against and beyond a corresponding plurality of projections on the outer surface of the rear wall of the printer. As the claws are slid against the projections, the claws are bent outwardly and assume their unbent positions once beyond the projections. The claws upon assuming their unbent position lock the guide plate to the frame and thereby serve to prevent the guide plate from warping by pressing the guide plate in a downwardly direction. The clips attached to the guide plate and projections along the rear wall of the frame eliminate the need for screws and the like in assembling the guide plate to the frame.

The printer also includes an outer bail plate and inner bail plate, which are adjacent to each other, for exerting different levels of pressure against the platen and a release assembly for controlling the level of pressure exerted by the pair of bail plates against the platen. The outer bail plate is typically made from metal. The inner bail plate is typically made from a polymer.

The release assembly includes a shaft for pressing against the outer bail plate. The shaft has a plurality of protrusions extending along its length. A release lever is slidably coupled to an intermediate lever which in turn is connected to the shaft. By moving the release lever in a first direction, the shaft will rotate and the protrusions from the shaft will press against the outer bail plate forcing the inner bail plate to exert sufficient pressure against the platen to ensure the recording medium is properly advanced through the printer. By moving the release lever in a second direction, the shaft is rotated so that the protrusions are no longer in contact with the outer bail plate resulting in the inner bail plate exerting far less pressure against the platen. Continuous sheets of paper therefore can be used without deforming the holes along the edge thereof and thereby prevent the paper from being advanced through the printer at an improper pitch. Each of the bail plates includes a plurality of openings extending along its length. Inserted through these openings is a triangular like projection connected to the frame of the printer which allows the bail plates to easily pivot toward the platen and to be assembled within the printer.

To facilitate the assembly of the frame to the frame plate of the printer, an L-shape projection extending from the side of the frame extends into an opening located along one end of the frame plate for aligning the frame to the frame plate. On the leg of the L-shaped projection which extends in a downwardly direction is a pair of strips for compensating for deviations in the manufacturing tolerances between the L-shaped projection and the opening in the frame plate. The frame also includes a pair of claws extending downwardly and outwardly from the L-shaped projection. Each of the claws has a sloped surface at its distal end angled towards the L-shaped projection.

The frame plate includes a pair of resilient fingers extending from the end of the frame plate. In assembling the frame to the frame plate, the resilient fingers slide against the sloped surfaces of the claws and are bent toward each other. Once the fingers advance beyond the distal ends of the claws, the fingers assume their unbent position thereby locking the frame to the frame plate.

The printer also includes a motor for generating a drive force to move a carriage, a timing belt coupled to the carriage, and transmitting means for transmitting the driving force to the timing belt. The motor, timing belt and transmitting means are all supported by the frame. In particular, the motor body is able to partially rotate while secured to the frame. A shaft rising above the motor and extending through an elongated opening in the frame around which a driving pulley for the timing belt rotates permits the shaft to move in a direction which stretches the timing belt during operation of the motor and thereby provides a constant tension on the timing belt.

Accordingly, it is an object of the invention to provide a printer having a guiding plate which can be simply and easily attached to the printer in a predetermined position without the precision demanded from commercially available printers.

It is another object of the invention to provide an improved printer which exerts different levels of pressure against a recording medium to accommodate continuous sheets of paper such as, but not limited to, computer paper whereby the holes along the edge of the paper are not deformed resulting in the paper being fed at an improper pitch through the printer.

It is a further object of the invention to provide an improved printer which avoids the need for a paper bail and thus eliminates complicating the structure of the printer.

It is yet another object of the invention to provide an improved printer wherein assembly of the frame plate to the frame of the printer is easily and simply accomplished in relatively little time.

It is yet a further object of the invention to provide an improved printer which provides the correct tension on a timing belt automatically and thereby eliminates the need to manually adjust the movement of a motor or position of a pulley.

Still other objects and advantages of the invention will in part be obvious and will in part be apparent from the specification.

The invention accordingly comprises the several steps in a relation of one or more of such steps with respect to each of the others, and the apparatus embodying features of construction, a combination of elements and arrangements of parts which are adapted to effect such steps, all is exemplified in the following detailed disclosure and the scope of the invention will be indicated in the claims.

BRIEF DESCRIPTION OF THE DRAWINGS

For a fuller understanding of the invention, reference is had to the following description taken in connection with the accompanying drawings, in which:

FIG. 8 is a fragmentary, diagrammatic sectional view of the printer in an operating mode for advancement of a continuous sheet of paper;

FIG. 9 is a diagrammatic, elevational view of a release lever during advancement of a sheet of continuous paper through the printer;

FIG. 10 is a fragmentary, diagrammatic sectional view of the printer in an operating mode for advancement of a non-continuous sheet of paper;

FIG. 11 is a diagrammatic, elevational view of the release lever during advancement of the non-continuous sheet of paper through the printer;

DETAILED DESCRIPTION OF THE PREFERRED EMBODIMENTS

Figure 1:
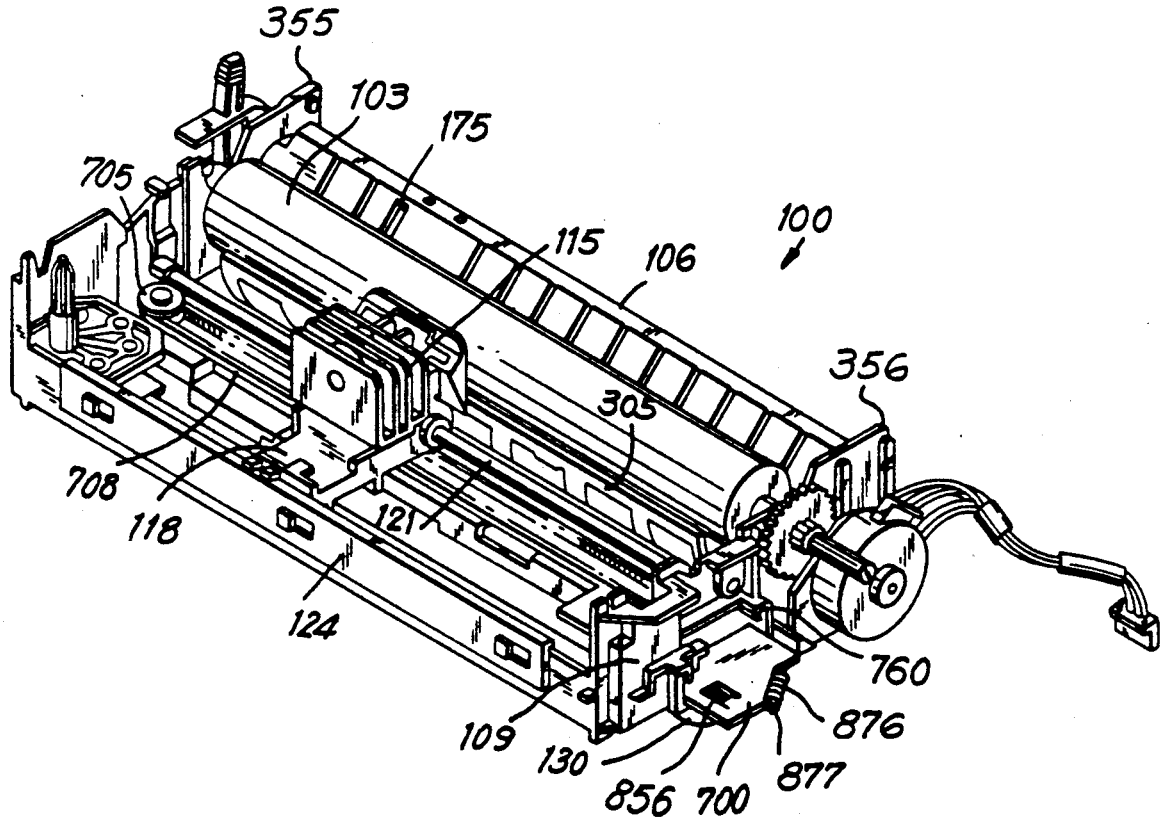
FIG. 1 is a perspective view of a printer in accordance with one embodiment of the invention.
Figure 2:
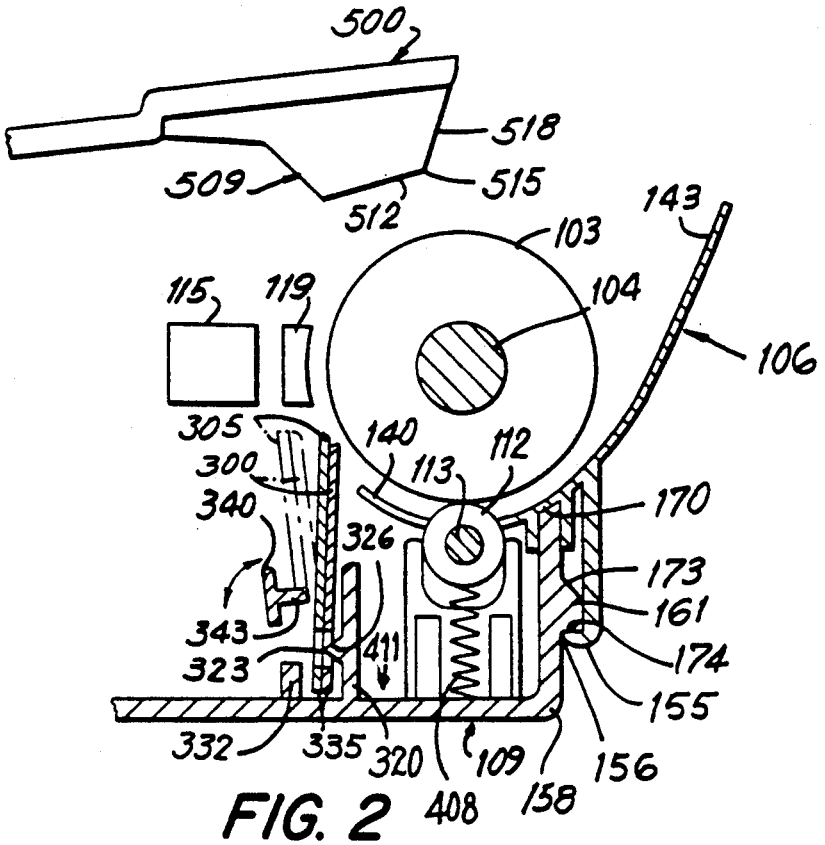
FIG. 2 is a fragmented sectional view of the printer.

As shown in FIGS. 1 and 2, a printer 100 includes a platen 103, guiding plate 106, bail plates 300 and 305, and paper controlling mechanism 500 all of which are detachably secured to a frame 109. Printer 100 also includes pressing rollers 112 and a printing head 115. Printing head 115 is mounted on a carriage 118 which is slidably supported on a shaft 121 and guided by a plate 124. A timing belt 708 is connected to a pulse motor 130, a following pulley 705 and carriage 118 for transmitting the driving force generated by motor 130 to carriage 118 for movement of carriage 118, in linear reciprocating directions. Pulse motor 130 is connected to frame plate 700 which is detachably fixed to frame 109. Platen 103 is supported on a shaft 104.

Figure 3:
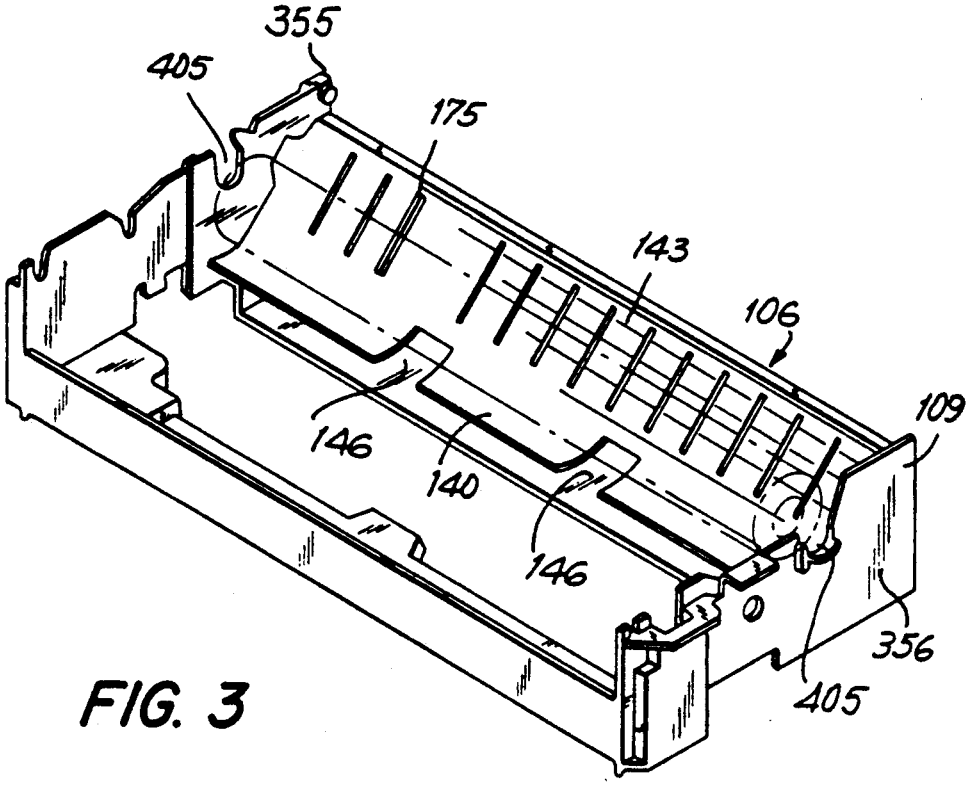
FIG. 3 is a perspective view of a frame and paper guide plate.

Referring now to FIGS. 2 and 3, guiding plate 106 includes a lower portion 140 and upper portion 143 and is positioned adjacent and partially concentric with platen 103. The radius of curvature of lower portion 140 is different from the radius of curvature of upper portion 143 providing a somewhat crooked shape to guiding plate 106. Lower portion 140 is also disposed adjacent to the platen 103 and is separated therefrom by a distance somewhat greater than the thickness of the recording medium to be advanced through the printer 100.

A recording medium such as a piece of paper stored in a storage member 144 is initially inserted between upper portion 143 of guiding plate 106 and platen 103 which forces the leading edge of the paper to advance toward lower portion 140. The leading edge is then fed between platen 103 and pressing rollers 112. The radius of curvature of lower portion 140 substantially conforms to the curvature of the circumference of platen 103 to ensure that the paper properly advances beyond lower portion 140. Lower portion 140 includes a plurality of notches 146 through which pressing rollers 112 extend. Upper portion 143 includes at least one substantially rectangular window 175 extending therethrough. A paper detector (not shown) detects the presence of the recording medium on upper portion 140 of guiding plate 106 through sensors (also not shown) which extend through window 175.

Figure 4:
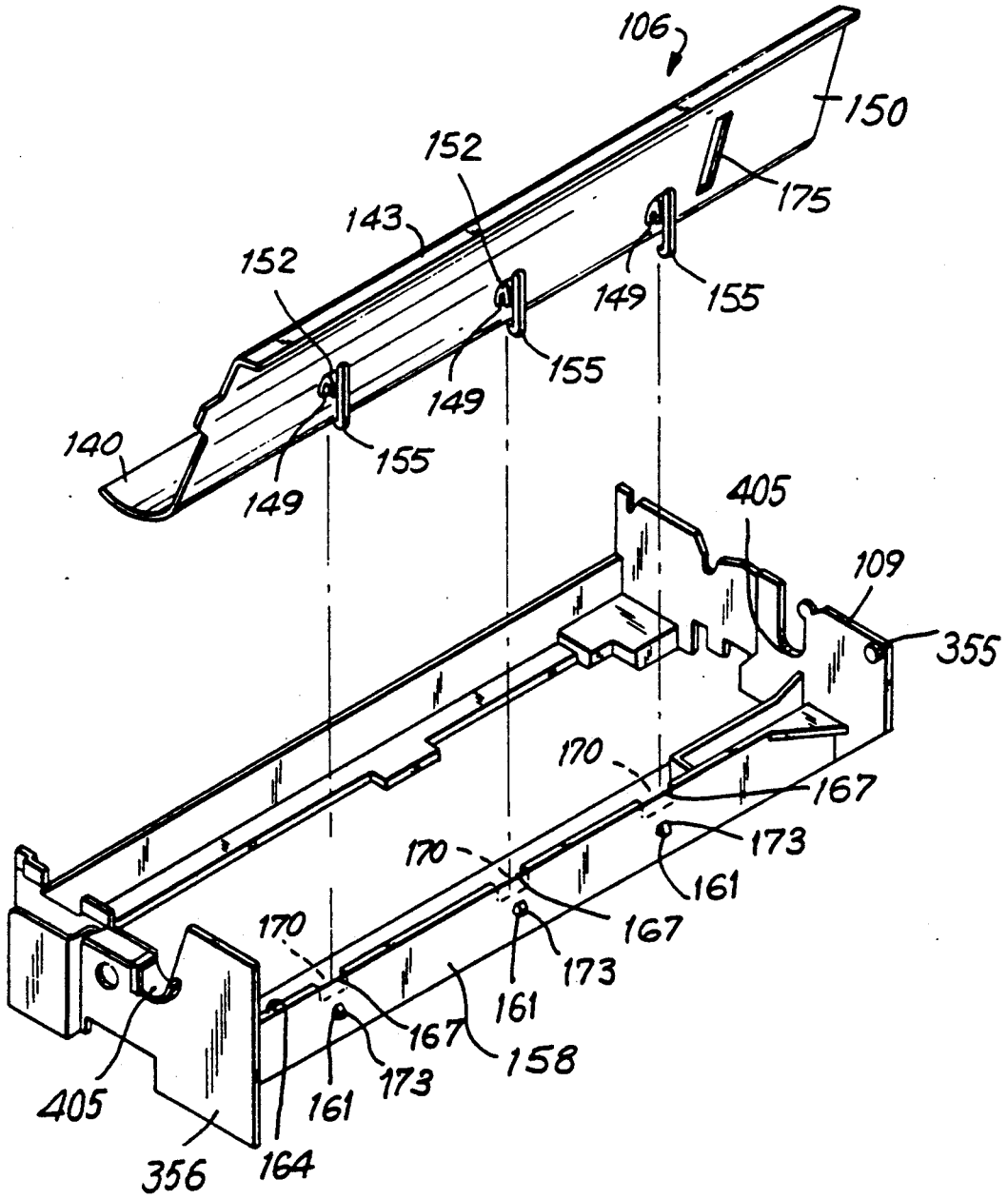
FIG. 4 is an exploded rear perspective view of the frame and paper guide plate of FIG. 3.

As shown in FIG. 4, a plurality of clips 149 are connected to a rear surface 150 of guiding plate 106 near the boundary between upper portion 143 and lower portion 140. Each of the plurality of clips 149 includes a substantially upside-down U-shaped member 152 and a claw 155 which extends downwardly from and is connected to U-shaped member 152. Each claw 155 includes a distal end 156. Clips 149 are made of a resilient material.

A rear wall 158 of frame 109 includes a plurality of projections 161 which correspond to the plurality of clips 149. Each projection 161 has a sloped surface 173 resembling in cross section a quarter moon. Each sloped surface 173 ends in a substantially planar bottom 174 extending laterally from the surface for engagement by the end of claw 155. A top edge 164 of rear wall 158 varies in thickness along its length and includes a plurality of narrow sections 167 positioned directly above projections 161 and corresponding to and dimensioned to slidably fit within the openings of the plurality of U-shaped members 152. Each section 167 has a sloped surface 170 conforming substantially to the curvature on the exterior surface of guiding plate 106.

Guiding plate 106 is connected to frame 109 by pushing guiding plate 106 towards rear wall 158 of frame 109 so that each U-shaped portion 152 engagingly receives a corresponding narrow section 167. Rear surface 150 then will be in contact with sloped surface 170 of narrow section 167. At the same time, claws 155 are bent outwardly as distal ends 156 slide along sloped surfaces 173 of projections 161. Upon reaching bottoms 174 of projections 161, distal ends 156 of claws 155 slide under bottoms 174. Claws 155 then assume their unbent position and thereby lock guiding plate 106 to frame 109.

Clips 149 serve two functions, namely, to secure guiding plate 106 to frame 109 and to maintain adequate spacing between guiding plate 106 (and especially lower portion 140) and platen 103. Guiding plate 106 is thereby easily connected and accurately positioned relative to platen 103 by clips 149. Additionally, any minor warpage or other minor deformation in upper portion 143 will be corrected by the downwardly and outwardly directed force exerted by claws 155 of clips 149 in their locked position under bottoms 174 of projections 161.

Figure 5:
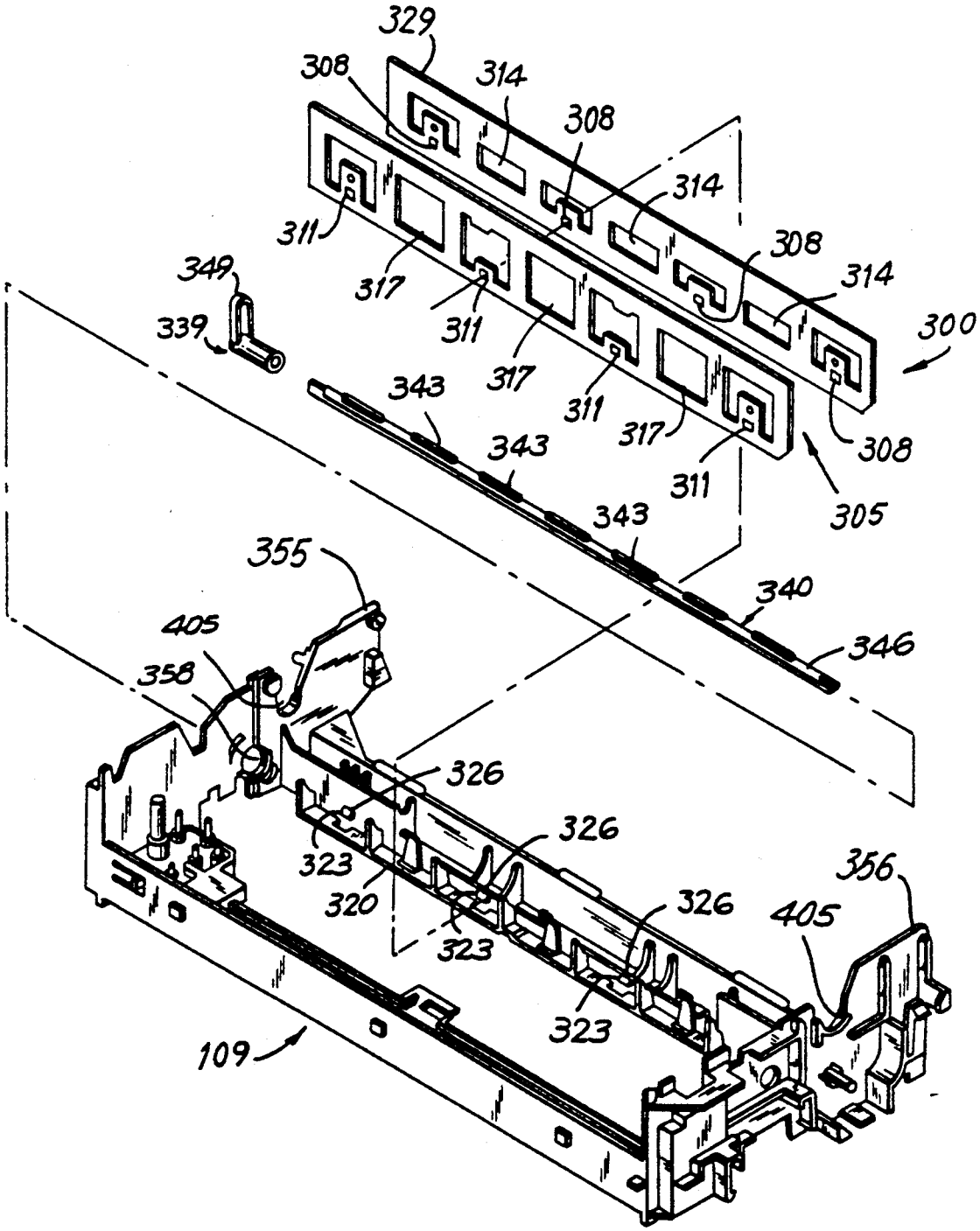
FIG. 5 is an exploded perspective view of a pair of paper bail plates, a portion of a release assembly and the frame.

As shown in FIG. 5, bail plates 300 and 305 are adjacent to each other and include a plurality of corresponding openings 308 and 311 and windows 314 and 317, respectively. Openings 308 and windows 314 of bail plate 308 are shown for illustrative purposes as alternating along the length of bail plate 300. Similarly, openings 311 and windows 317 of bail plate 305 are alternately located along the length of bail plate 305.

Bail plate 300, which includes an upper edge 329, need not be very resilient but should have a small coefficient of friction relative to the recording medium which rubs against it. Additionally due to the constant contact with the recording medium, bail plate 300 should be made from materials which wear well. Suitable materials for bail plate 300 include, but are not limited to, polymer resins (i.e. a film of Teflon, a registered trademark of E.I. du Pont de Nemours & Co.), polyimide film and polyester film. Bail plate 305 which is made of a metallic material, pushes bail plate 300 towards platen 103. Preferably, bail plate 305 should exhibit spring-like characteristics and be made from a material such as, but not limited to, stainless steel. Another suitable material for bail plate 305 is steel having a nickel plated surface. Both bail plates 300 and 305 have substantially rectangular perimeters and bottoms 335.

Extending across the length of frame 109 is a cross plate 320. A plurality of projections 323 having triangular cross sections are located along the length of cross plate 320 and are disposed to receive the plurality of openings 308 and 311. Each projection 323 has a sloped upper surface 326 inclined in a substantially vertical direction so that upon inserting projections 323 through openings 308 and 311 bail plates 300 and 305 can be urged towards platen 103.

Referring once again to FIG. 2, a stopper 332 located on frame 109 is positioned to prevent bail plates 300 and 305 from slipping off projections 323. Consequently, bail plates 300 and 305 can be easily and quickly attached to frame 109 by slipping bottoms 335 between stopper 332 and cross plate 320 and inserting projections 323 through openings 308 and 311, respectively.

As shown in FIG. 5, a portion of a release assembly 339 for controlling the pressure exerted by pressing bail plates 300 and 305 and the position of pressing roller 112 includes a release shaft 340 having a plurality of rectangular projections 343 on an upper surface 346. Release shaft 340 is rotatable by rotation of an intermediate lever 349. As explained in greater detail below, by transmitting a relatively small amount of force against intermediate lever 349 in a direction away from platen 103, release shaft 340 will reduce the pressure exerted by bail plate 305 against bail plate 300 which in turn presses against platen 103. Contrastingly and as shown in FIG. 2, by turning intermediate lever 349 in a direction toward platen 103, projections 343 of release shaft 340 press against bail plate 305 so as to increase the pressure exerted by bail plate 300 against platen 103.

As shown in FIGS. 2, 8 and 10, projections 343 of release shaft 340 contact bail plate 305 other than at the top end or bottom end of the latter in controlling the level of pressure exerted by bail plate 300 against platen 103.

Figure 6A:
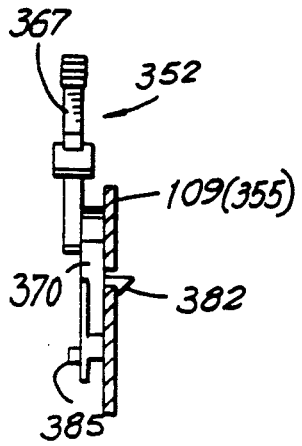
FIG. 6*a* is a fragmented sectional view of FIG. 5.
Figure 6B:
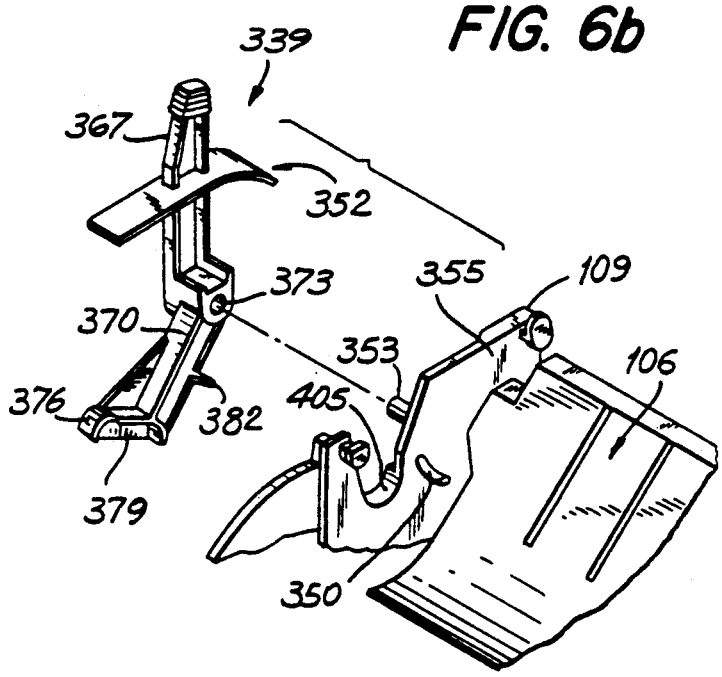
FIG. 6*b* is an exploded perspective view of FIG. 6*a;*
Figure 7A:
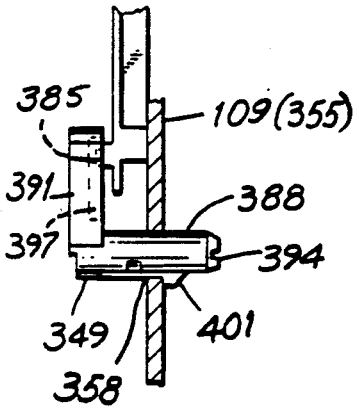
FIG. 7*a* is a sectional view of the remaining portion of the release assembly.
Figure 7B:
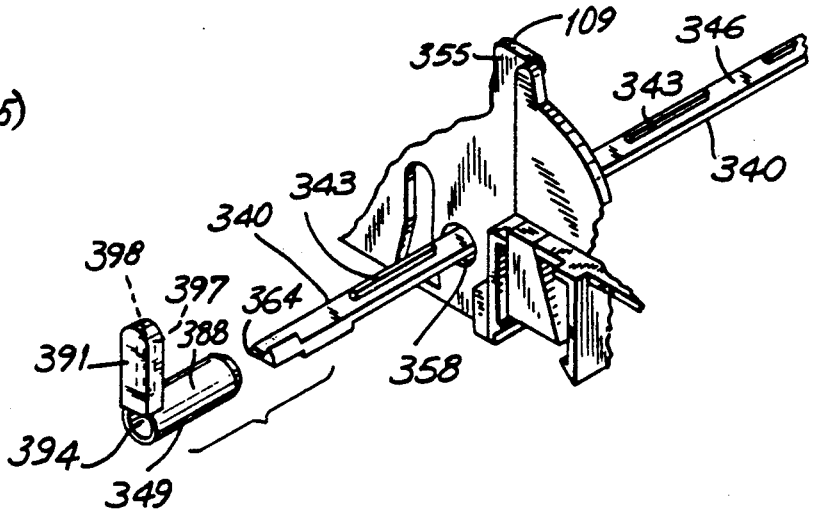
FIG. 7*b* is a perspective view of the release assembly of FIG. 7*a;*

As shown in FIGS. 6*b* and 7*b*, side wall 355 includes an arc shaped window 350 and a substantially circular opening 358. Shaft 340 extends through opening 358 and also includes an end 364. FIGS. 6*a*, 6*b*, 7*a* and 7*b* illustrate different portions of release assembly 339. A release lever 352 of assembly 339 has arm 367 which is connected to a leg 370. At the junction of arm 367 and leg 370 is an opening 373. A foot 376 of leg 370 includes an arch-like groove 379. Leg 370 also includes an inwardly protruding extension 382 and an outwardly protruding extension 385. Extension 382 resembles a single wing arrowhead. Opening 373, which is positioned at the pivotal center of release lever 352, is dimensioned to slidably receive a pin 353 of side wall 355 of frame 109. With pin 353 extending into opening 373, extension 382 protrudes into window 350 of side wall 355 and can be rotated in tangential directions relative to the curved surface of window 350.

Archlike groove 379 is shaped so that the both ends are concave at the side of the opening 373 (see FIG. 6*b* and FIG. 11). Guide shaft 113 urged by the upper portion shown in FIG. 11 is stabilized in the concave portion by force of coil spring 408 and, therefore, release lever 352 is held in the state shown in FIGS. 9 or 11.

Intermediate lever 349 includes a cylindrical portion 388 and a substantially rectangular portion 391 with a curved end. Rectangular portion 391 is disposed substantially perpendicular to cylindrical portion 388. Along the major axis of cylindrical portion 388 is an opening 394 which is dimensioned to slidably receive end 364 of release shaft 340. Portion 391 includes a substantially rectangular opening 397 having a curved end 398 for slidably receiving extension 385 of release lever 352. Intermediate lever 349 also includes a resilient claw 401 which is bent inwardly toward cylindrical portion 388 when inserted through opening 358 of frame 109. Once claw 401 travels beyond opening 358, it assumes its unbent position thereby rotatably locking intermediate lever 349 to frame 109.

A pair of grooves 405 which are formed in side wall 355 and a side wall 356 (as shown in FIG. 5) of frame 109, rotatably support a shaft 113 (as shown in FIG. 2) of pressing roller 112. Grooves 405 also guide shaft 113 so that pressing roller 112 can move in substantially upwardly and downwardly directions. A coil spring 408, also shown in FIG. 2, is disposed within an opening 411 of frame 109 and biases pressing roller 112 towards platen 103.

FIGS. 8 and 9 illustrate the position of pressing roller 112 and release lever 352 when a continuous sheet of paper F (such as, but not limited to, a roll of computer paper) is to be advanced through printer 100. With release lever 352 positioned as shown in FIG. 9, one end of shaft 113 of pressing roller 112, which is disposed within groove 379 of foot 376 of release lever 352, is forced to move in a downwardly direction away from platen 103. At the same time, extension 385 of release lever 352 slides away from curved end 398 and within opening 397 of intermediate lever 349 causing lever 349 to rotate away from platen 103. Intermediate lever 349 through its connection to end 364 of release shaft 340 in turn rotates release shaft 340 such that surface 346 rather than projection 343 is in contact with bail plate 305. Bail plates 300 and 305 therefore exert relatively little pressure against platen 103. Accordingly, as the recording medium travels about the circumference of platen 103, bail plate 300 will not inhibit the advancement of continuous sheet of paper F through printer 100.

Advancement of continuous sheet of paper F is accomplished through a sprocket /tractor 414 having a plurality of teeth 1411. As sprocket 414 rotates in a direction denoted by an arrow A, teeth 411 are successively inserted into a series of holes (not shown) located along one or both edges of paper F. Since the pressure of bail plates 300 and 305 have been weakened and pressing roller 112 is separated from platen 103, as described heretofore, there is no drag placed on paper F by bail plate 300 or pressing roller 112 which deforms the holes along the edge of paper F. Accordingly, the correct pitch of the holes along the edge of paper F relative to teeth 411 is maintained ensuring proper advancement of paper F through printer 100. The circumferential (i.e. angular) speed of platen 103 is less than the angular speed at which sprocket 414 rotates. Paper F therefore is slidingly fed along the surface of platen 103.

FIGS. 10 and 11 illustrate the positions of pressing roller 112 and release lever 352 when a single sheet of noncontinuous paper K (such as, but not limited to, a sheet of A4 size paper) is advanced through printer 100. Release lever 352 is now positioned such that shaft 113 of pressing roller 112 slides along groove 379 in an upwardly direction toward platen 103. At the same time, extension 385 of release lever 352 slides towards curved end 398 and within opening 397 of intermediate lever 349 causing intermediate lever 349 to rotate toward platen 103. Release shaft 340 now rotates so that projections 343 rather than surface 346 contacts pressing bail plate 305 and biases bail plate 305 towards platen 103. Bail plate 300 now exerts far greater pressure against platen 103. Since paper K is now also pressed against platen 103 by pressure roller 112, as platen 103 rotates in the direction of an arrow B, paper K advances through printer 100. Bail plate 300 by pressing against paper K as the latter advances past plate 300 ensures that paper K is smoothly fed between printing head 115 and platen 103.

Figure 12:
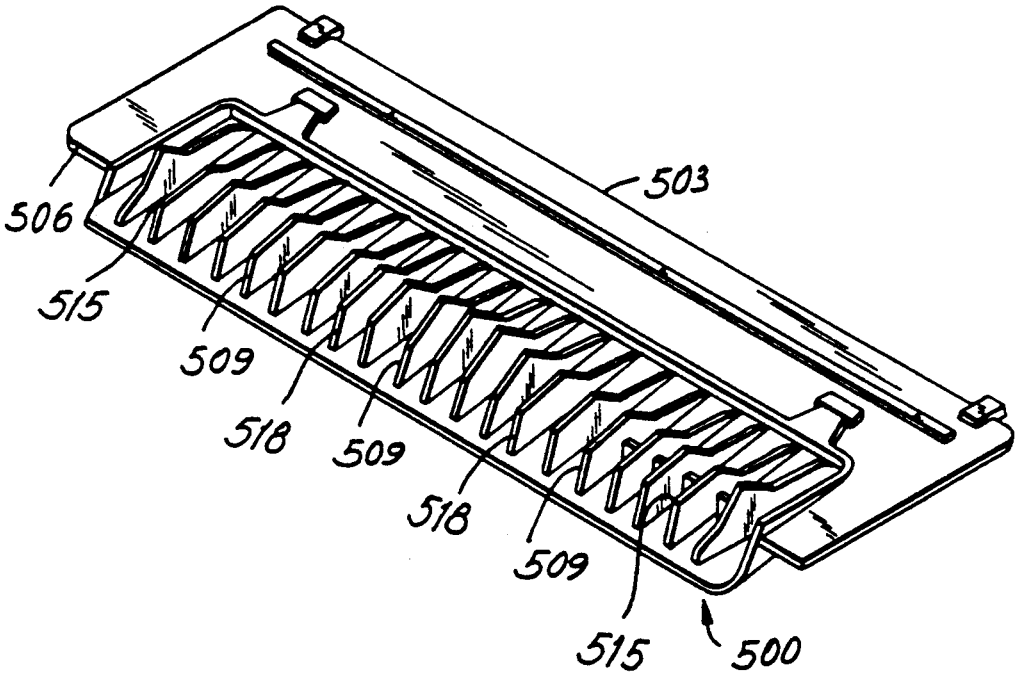
FIG. 12 is a perspective bottom view of a cover of the printer.

Referring now to FIG. 12, paper controlling mechanism 500 includes a cover 503 having a plurality of ribs 509. Cover 503 is rotatably mounted to the top of the casing of printer 100. With cover 503 rotated to a horizontal position during operation of printer 100, cover 503 is directly above printing head 115 and ribs 509 extend in a direction which is substantially perpendicular to the major axis of platen 103. Cover 503 resembles a substantially rectangular plate with ribs 509 extending beyond an edge 506 of cover 503.

Figure 13:
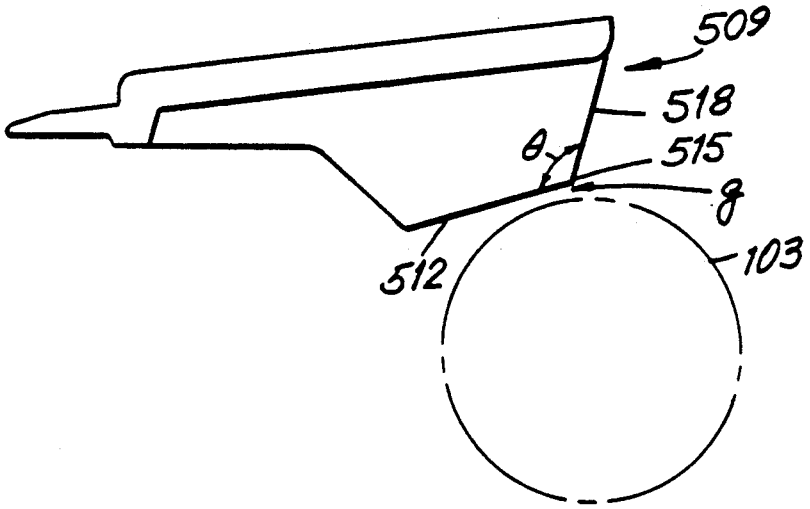
FIG. 13 is a fragmentary sectional view of FIG. 12.

As shown in FIG. 13, each rib 509 includes a first sloped, substantially planar surface 512. During operation of printer 100, surfaces 512 are disposed near platen 103 and together define a first guide surface. Each rib 509 also includes a corner (i.e. vertex) 515 and a second sloped substantially planar surface 518. For exemplary purposes, an angle $\theta$ representing the angular displacement between surfaces 512 and 518 is shown at least equal to or greater than 90°. First guide surfaces 512 serve to guide the leading edge of the recording medium which has advanced beyond printing head 115 towards platen 103. Corners 515 are positioned relative to platen 103 so as to place that portion of the recording medium which has advanced beyond print head 115 against platen 103. A gap "g" between corner 515 and platen 103 is as narrow as possible while permitting the recording medium to travel past corner 515. Surfaces 518 define a second guide surface and serve to guide the recording medium during discharge from printer 100.

Figure 14A:
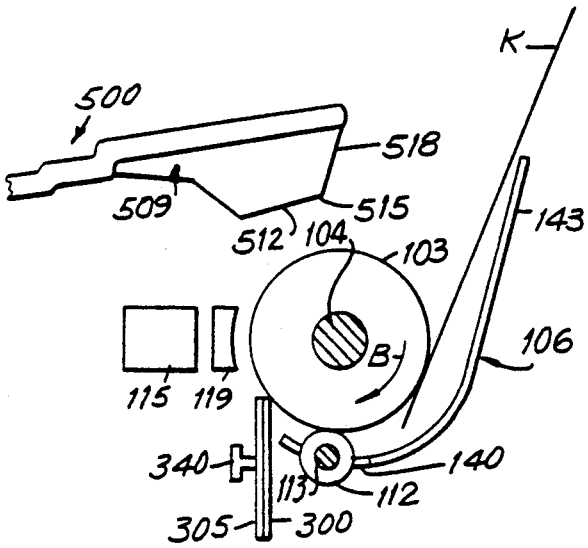
FIGS. 14*a*, 14*b*, 14*c* and 14*d* are fragmentary sectional views of the printer during advancement of a sheet of paper therethrough.
Figure 14B:
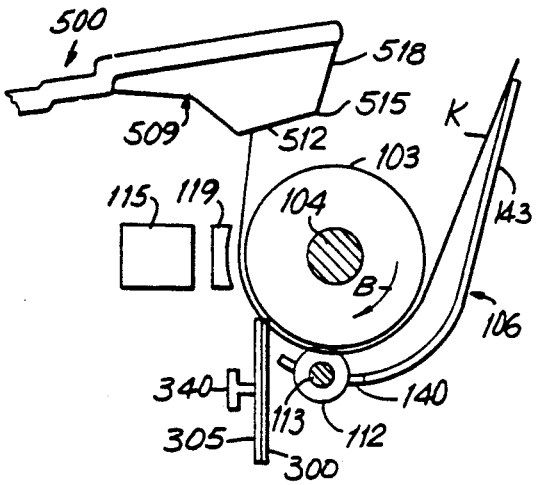
Figure 14C:
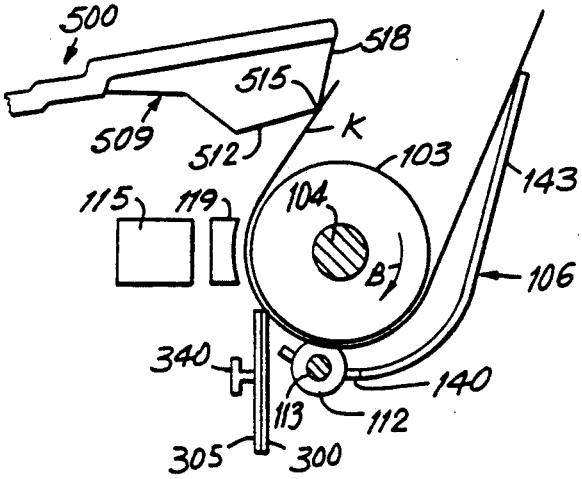
Figure 14D:
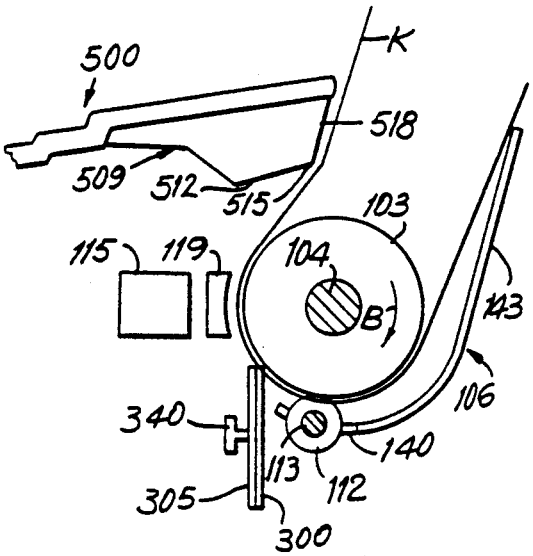

FIGS. 14*a*, 14*b*, 14*c* and 14*d* illustrate the various positions assumed by paper K as paper K proceeds through printer 100 with cover 500 rotated into its horizontal position. FIG. 14*a* shows paper K initially inserted between platen 103 and upper portion 143 of guiding plate 106. The detector (not shown) determines the presence of paper K between platen 103 and upper portion 143 through sensors (also not shown) which extend through window 175 (shown in FIG. 3). Upon sensing the presence of paper K, platen 103 begins to rotate in the direction of arrow B. Paper K is guided along upper portion 143 and is then directed toward lower portion 140 of guiding plate 106. Pressing roller 112 exerts pressure against paper K ensuring that as platen 103 rotates in the direction of arrow B paper K is advanced toward pressing bail plates 300 and 305.

Bail plate 300 presses paper K against platen 103. Due to bail plate 300 forcing paper K against platen 103, paper K is properly positioned to be inserted and advanced through a paper guiding portion 119 of carriage 118. Since paper guiding portion 119 has an extremely low coefficient of friction, paper K is fed smoothly therethrough as platen 103 rotates in the direction of arrow B. A relatively high torque for rotating platen 103 and a suitable material for the surface of platen 103 such as, but not limited to, rubber is provided for advancing paper K beyond bail plate 300 to overcome the pressure exerted by bail plate 300 against paper K. Other suitable materials for platen 103 should have a relatively high coefficient of friction and be able to sustain the continual impact from printhead 115 striking platen 103.

As paper K advances beyond printing head 115, that is, travels beyond carriage 118, paper K strikes a plurality of sloped surfaces 512 of ribs 509 as shown in FIG. 14(*b*). The leading edge of paper K travels along sloped surfaces 512 towards platen 103 until reaching corners 515 as shown in FIG. 14 (*c*). As a result, that portion of paper K which has advanced beyond printing head 115 is placed against platen 103. When paper K is advanced to a predetermined position relative to printing head 115, rotation of platen 103 is halted and printing is begun. Upon completion of one line of print, platen 103 is rotated by at least the height of the line of print. Eventually, as paper K advances beyond printing head 115 and passes beyond corners 515, the leading edge of paper K follows surface 518 and is discharged from printer 100 as shown in FIG. 14 (*d*).

Figure 15:
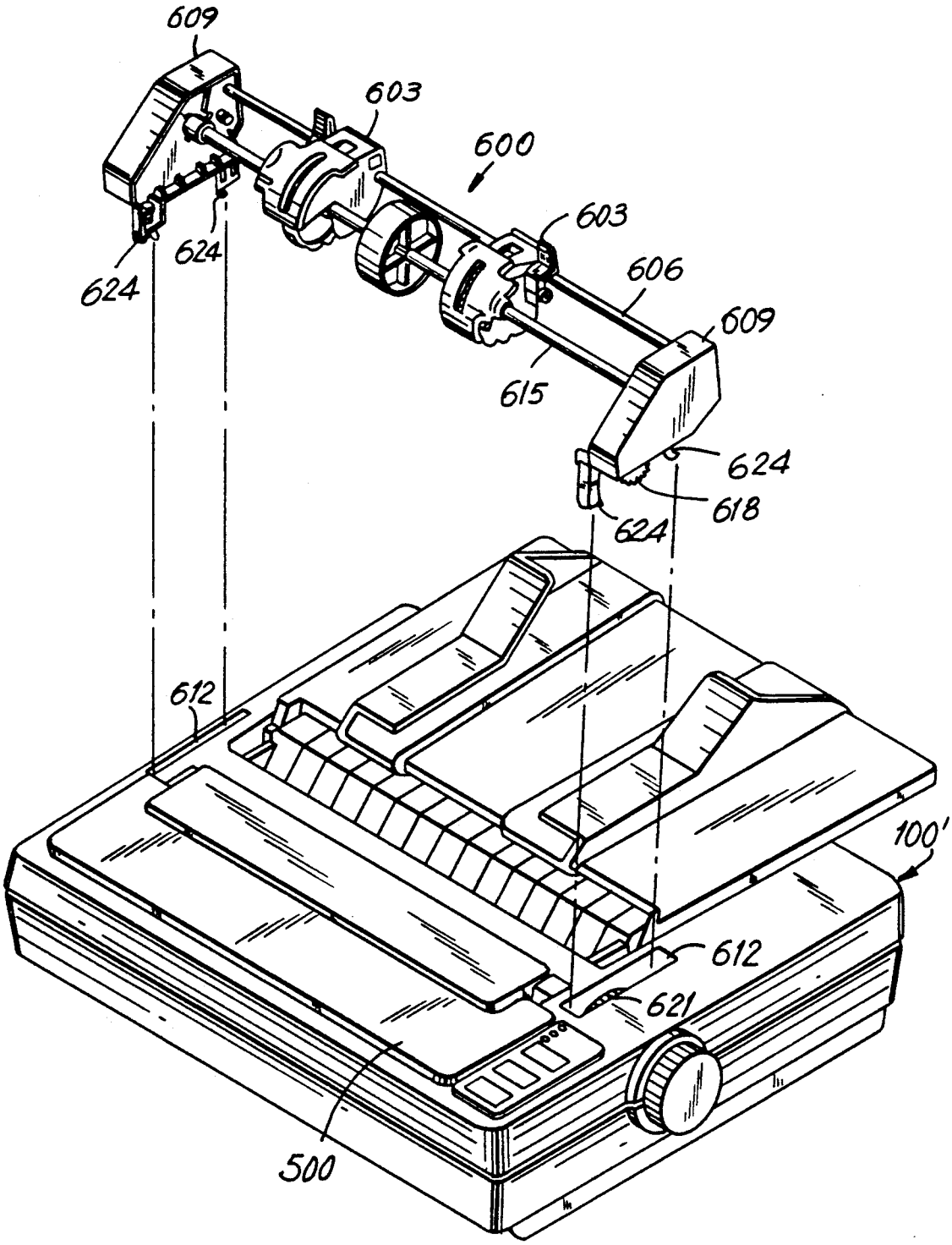
FIG. 15 is an exploded perspective view of a printer in accordance with another embodiment of the invention.

As shown in FIG. 15, a continuous paper feeding mechanism 600 includes a pair of sprockets 603 similar to sprocket 414 which are slidably mounted on a shaft 606. Sprockets 603 slide along shaft 606 and are positioned in accordance with the location of holes along the edge(s) of paper F. Each end of shaft 606 is connected to a support 609 which is mounted within opening 612 of a printer 100'. An additional shaft 615 is rotatably connected at both ends to supports 609. On end of shaft 615 is engaged by a gear train 618. Gear train 618 meshes with a wheel 621 which is connected to a shaft 104 of platen 103 (shown in FIG. 2). Connected to the bottom of each structure 609 are a pair of claws 624 located at opposite corners of structure 609 for removably securing structures 609 to printer 100' by engagement with the perimeters of openings 612.

Figure 16:
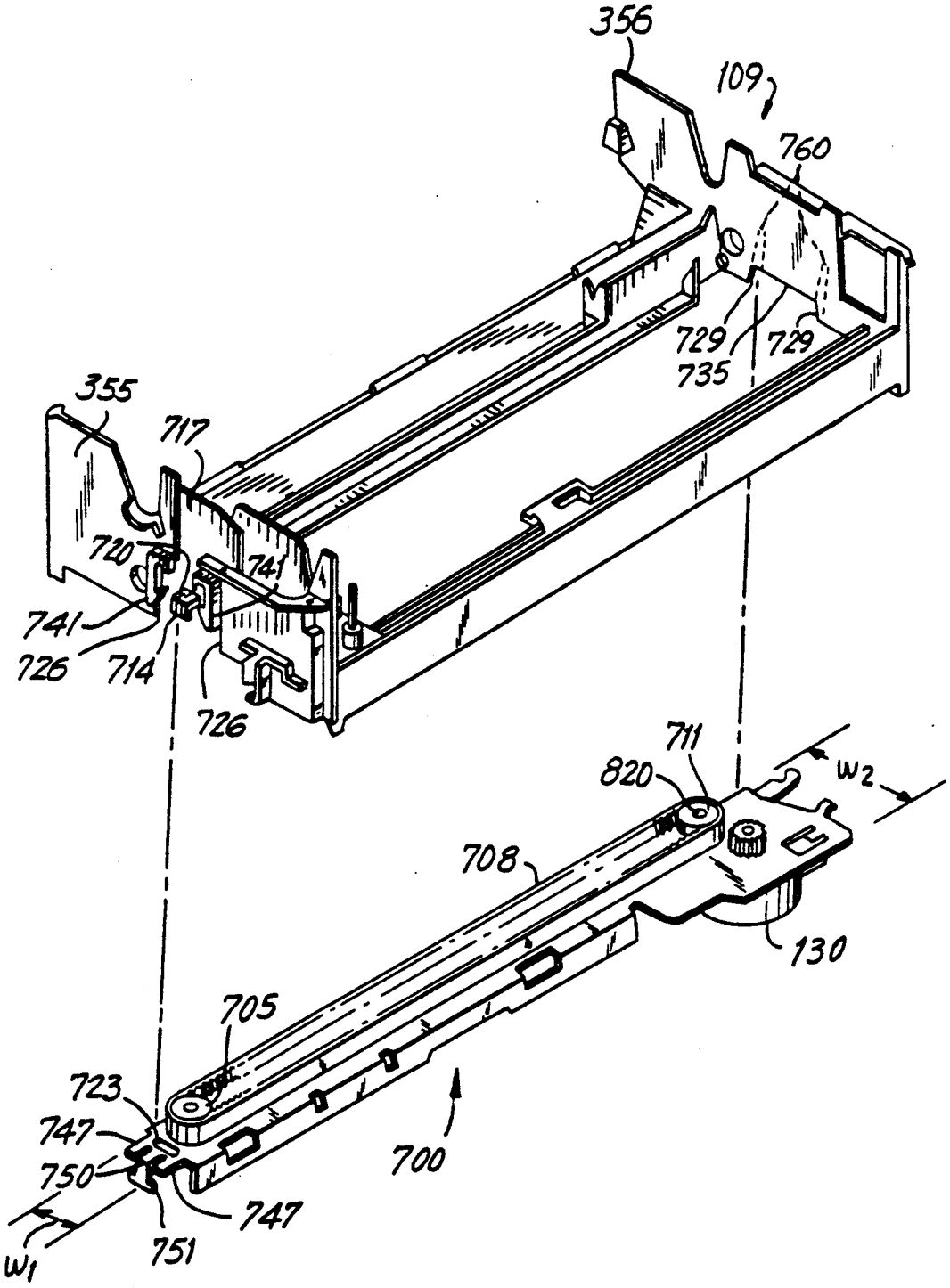
FIG. 16 is an exploded perspective view of a frame plate and frame of the printer.

As shown in FIG. 16, a frame plate 700 made of a metal such as, but not limited to, steel has connected thereto a pulse motor 130 disposed on a bottom surface of frame plate 700 and a follower pulley 705 disposed on the top surface of frame plate 700. A timing belt 708 connects follower pulley 705 to a driving pulley 711 which is connected to a shaft 820 of motor 130.

Frame 109 is formed by injection molding and dimensioned so that platen 103 and guiding member 106 can be mounted thereon as described heretofore. A substantially L-shaped projection 714 extends from a side wall 717 of frame 109. Side wall 717 is adjacent to side wall 355 of frame 109. Projection 714 is dimensioned so that a leg 720 thereof is slidingly received by a window 723 of frame plate 700.

Figure 17:
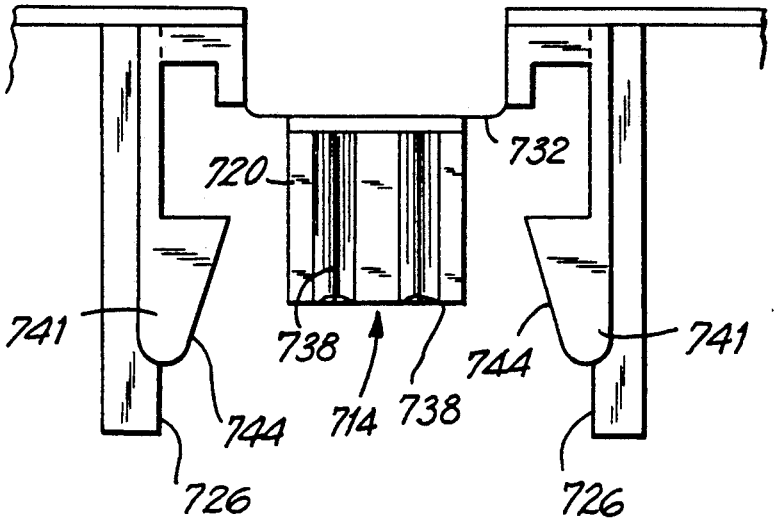
FIG. 17 is a fragmentary sectional view of FIG. 16.
Figure 18:
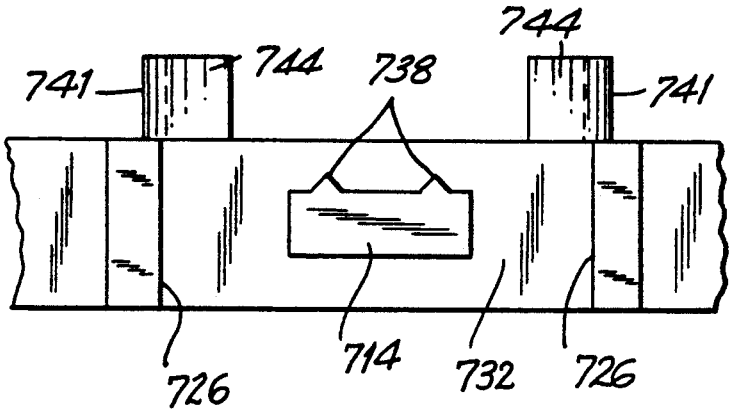
FIG. 18 is a fragmentary bottom plan view of FIG. 16.

Referring now to FIGS. 16, 17 and 18, frame 109 includes a pair of walls 726 and a pair of walls 729. Walls 726 are disposed diametrically opposite each other and are separated from each other by a distance slightly greater than a width $w_1$ at one end of frame plate 700. Similarly, walls 729 are disposed diametrically opposite one another and are separated from each other by distances slightly greater than a width $w_2$ at the other end of frame plate 700.

Disposed between walls 726 and walls 729 are reference surfaces 732 and 735, respectively. Reference surface 732 is located at the bottom of and integral with side wall 717. Projection 714 extends outwardly from reference surface 732. Triangular-like strips 738 protrude along the length of leg 720 of projection 714. As discussed below, strips 738 ensure that projection 714 properly fits within window 723. A pair of claws 741, which include at their distal ends sloped surfaces 744 inclined toward projection 714, are positioned adjacent to walls 726 and are integrally connected to frame 109.

Frame plate 700 also includes a pair of outer fingers 747 and an intermediate finger 750. Middle finger 750 has a T-shaped bar 751 at its distal end which extends at a right angle to the proximal end of intermediate finger 750 and outer fingers 747. Outer fingers 747 are sufficiently resilient so that in connecting frame plate 700 to frame 109, fingers 747 when pressed against sloped surfaces 744 of claws 741 bend toward each other. As outer fingers 747 continue to travel along and eventually beyond sloped surfaces 744 in a direction toward projection 714, outer fingers 747 assume their unbent position thereby locking frame plate 700 to frame 109.

Figure 19A:
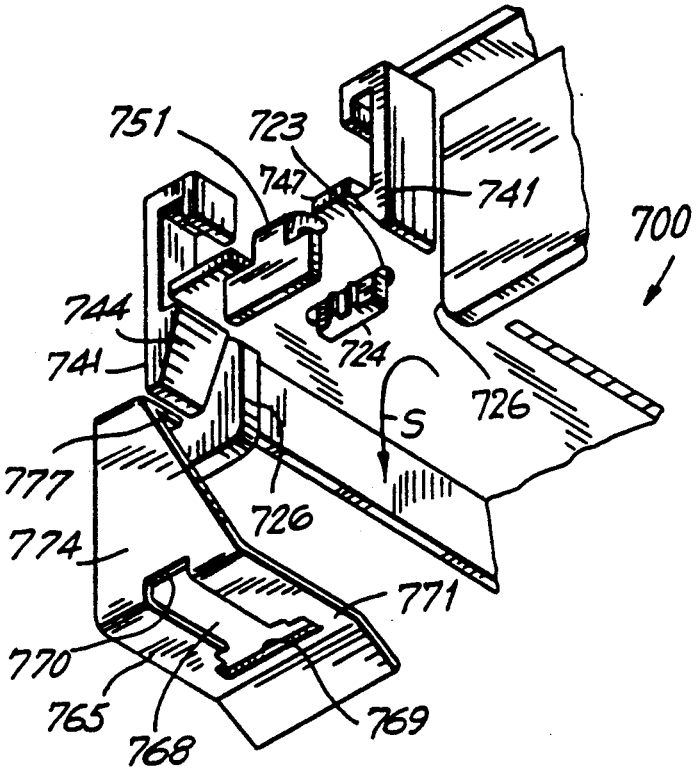
FIG. 19*a* is an exploded perspective view of a clip prior to connection to the frame plate.

At the same time, leg 714 is inserted into and partially passes through window 723 as shown in FIG. 19*a*. Once in this locked position, reference surfaces 732 and 735 are in contact with frame plate 700. Strips 738 of leg 714 (FIGS. 17 and 18) are made from a less rigid material then frame plate 700. Accordingly, in fitting leg 714 into window 723 any deviations in manufacturing tolerances between leg 714 and window 723 are compensated for by strips 738. FIG. 1 illustrates an additional pair of claws 760 similar in shape and function to claws 741 to secure the other end of frame plate 700 to frame 109.

Figure 19B:
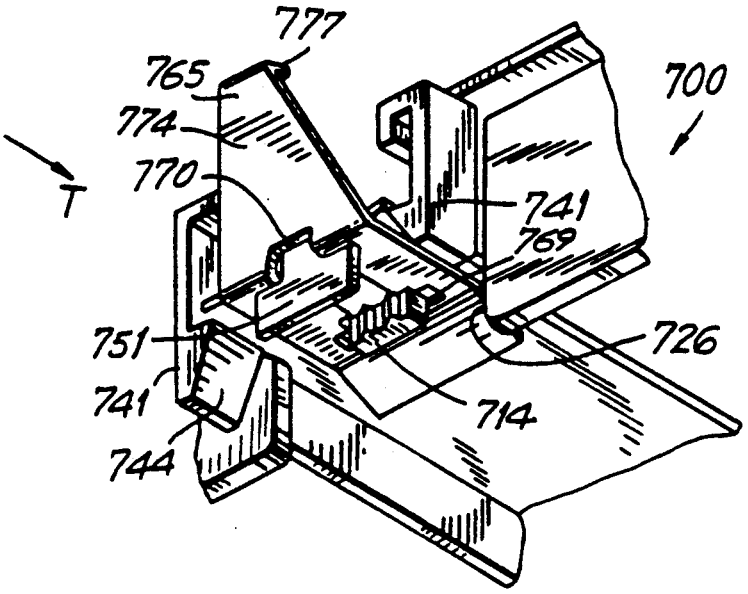
FIG. 19*b* is a perspective view of the clip connected to the frame plate.

As shown in FIGS. 19*a* and 19*b*, an L-shaped clip 765 made from a relatively thin plate of flexible metallic material has a substantially T-shaped opening 768 along a bottom leg 771 thereof. T-shaped opening 768 includes a top 769 and a bottom 770. Leg 771 is bent slightly downwardly and outwardly at its distal end. A second leg 774 of clip 765 has a distal end 777 which extends substantially parallel to leg 771. Legs 771 and 774 are separated by an angle of greater than 90 degrees. Clip 765 is fixed to frame plate 700 by first inserting T-shaped bar 751 through top 769 of opening 768 in a direction denoted by an arrow S as shown in FIG. 19*a*. Clip 765 is then slid in a direction denoted by an arrow T as shown in FIG. 19*b* until projection 714 extends through top 769 of opening 768 and T-shaped bar 751 reaches bottom 770 of opening 768. Distal end 777 then will be in direct contact with shaft 121.

Assembly of frame plate 700 to frame 109 as disclosed above ensures a secure connection therebetween and electrically connects carriage 118 to frame 109 thereby improving noise resistance. Carriage 118 is adhesively or through other suitable means fixed to timing belt 708. Operation of pulse motor 130 through coupling to timing belt 708 results in carriage 118 and printing head 115 moving in linear reciprocating directions. Since frame plate 700 is secured to frame 109, characters and symbols on any given line can be printed on the recording medium by printing head 115 without varying in distance or height from each other due to the movement of carriage 118. A high level of print quality is therefore produced by printer 100.

Frame plate 700 as described above has been mounted below frame 109. Alternatively, frame plate 700 can be mounted above frame 109 while maintaining the same high level of print quality by printer 100. Similarly, although only one projection 714 has been described heretofore, an additional projection 714 mounted to reference surface 735 can be employed by providing an additional opening (not shown) similar to window 723 located on the other end of frame plate 700 to receive the additional projection 714. Furthermore, although two strips 738 have been disclosed above, any number of strips can be employed.

Figure 20:
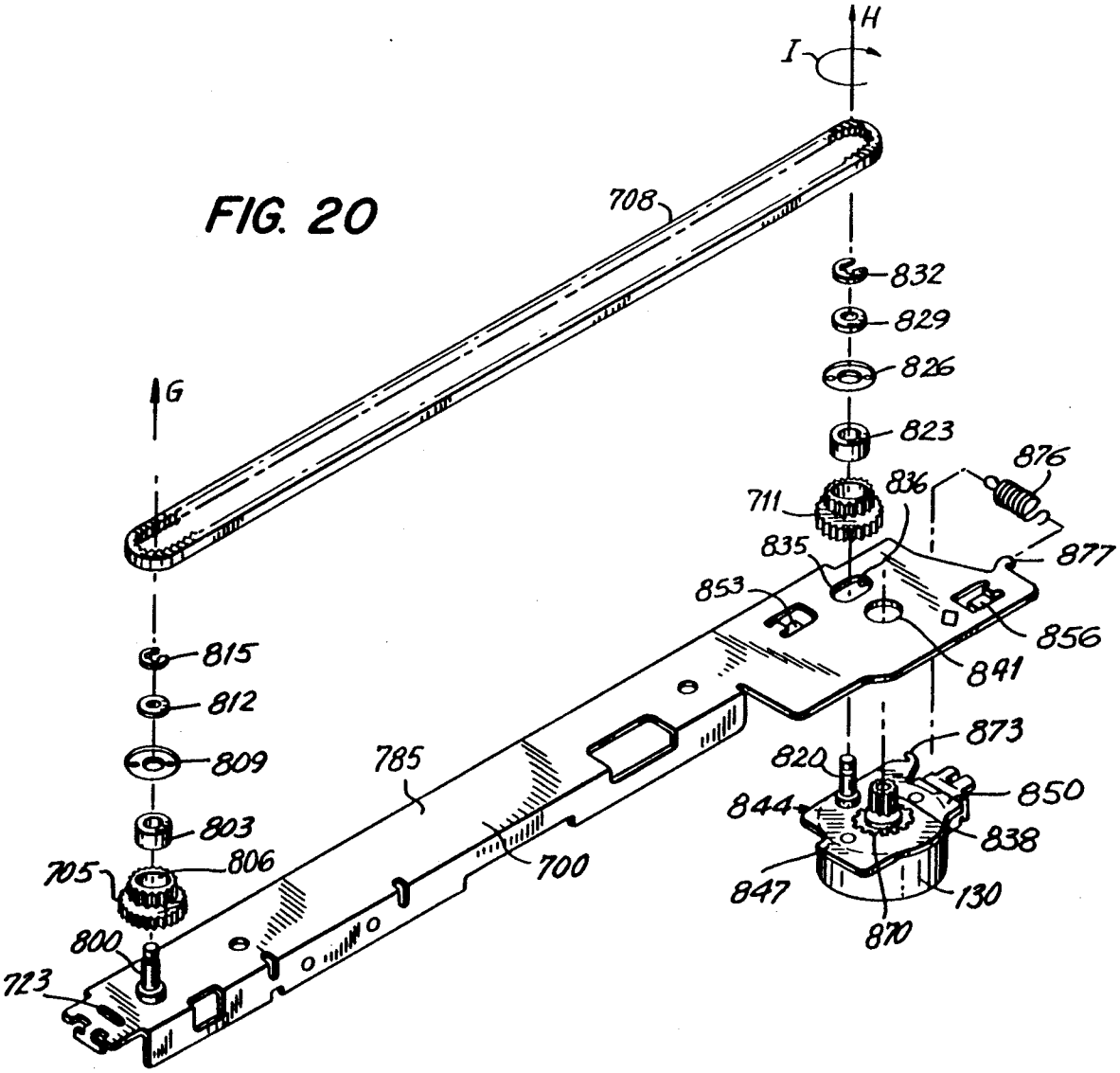
FIG. 20 is an exploded perspective view of the frame plate and a carriage driving mechanism.

Shown in FIG. 20, is a shaft 800 fixed to a top surface 785 of frame plate 700. Following pulley 705 is rotatably supported about shaft 800 through a plastic bearing 803 disposed within an inner opening 806 of following pulley 705. Following pulley 705 is prevented from moving in an axial direction denoted by an arrow G through a flange 809, plastic ring 812 and E-shaped stopper ring 815 which are mounted to the distal end of pulley shaft 800.

Pulse motor 130 includes shaft 820 extending from the base of motor 130. Driving pulley 711 rotates about shaft 820 through a bearing 823 and is prevented from moving in an axial direction of shaft 820 as denoted by an arrow H through a flange 826, plastic ring 829 and an E shaped stopper ring 832 connected to the distal end of shaft 820. Shaft 820 extends through a somewhat oval shaped hole 835. A pinion 838 extends through circular opening 841 of frame plate 700 and meshes with the teeth of driving pulley 711.

A plate 844 has a pair of rims 847 and 850 which are slidably secured to a pair of hook shaped projections 853 and 856 of frame plate 700, respectively. Hook-shaped projections 853 and 856 extend below the bottom surface of frame plate 700 and serve to hold pulse motor 130 in place. Timing belt 708 extends between and wraps around following pulley 705 and driving pulley 711. An O-shaped protrusion/ring (not shown) rises above and is connected to plate 844. Pinion 838 extends through the inner circular opening of protrusion 870. Protrusion 870 is inserted into and engages the perimeter of opening 841 to support and hold pulse motor 130 to frame plate 700.

In operation, pulse motor 130 rotates in a direction denoted by an arrow I forcing shaft 820 to pivot towards and contact an edge 836 of hole 835. Timing belt 708 is therefore further stretched resulting in a desired constant tension during operation of motor 130. At one corner of plate 844 is a hook shaped rim 873. A tension spring 876 is connected at one end to projection 873 and at its other end to a hook 877 integral with frame plate 700. The distance that timing belt 708 is stretched and the resulting tension thereon (i.e. the distance which pulse motor 130 rotates) corresponds to the spring force and displacement of tension spring 876. Pinion 838, driving pulley 711 and bearing 823 therefore serve as a transmitting mechanism for transferring the driving force generated by pulse motor 130 to timing belt 708.

In assembling pulse motor 130 and timing belt 708 to frame plate 700, shaft 820 and pinion 838 are first inserted into hole 835 and opening 841, respectively. Pulse motor 138 is then rotated in the direction of arrow I so that rims 847 and 850 are engaged by hook shaped projections 853 and 856, respectively. Driving pulley 711, plastic bearing 823, flange 826, plastic ring 829 and E shaped ring 832 are then placed on shaft 820. Timing belt 708 is then placed around following pulley 705 and driving pulley 711. Thereafter, tension spring 876 is assembled to hook shaped projections 873 and 876.

As now can be readily appreciated, the invention avoids requiring a high degree of precision in the location of the guiding plate 106 within printer 100. The pressure exerted by pressing bail plates 300 and 305 can be varied thereby permitting the use of continuous sheet of paper F in printer 100 without deforming the holes along the edge of paper F. Consequently, the correct pitch at which paper F is fed through printer 100 is maintained.

Due to plates 300 and 305 and ribs 509 together performing the separate operations of a paper bail and a paper pressing plate found in conventional printers, printer 100 eliminates the need for a separate paper bail. Therefore, no additional mechanism for automatically opening or closing the paper bail is required. Still further, connection of frame plate 700 to frame 109 can be easily and quickly accomplished. Printer 100 also requires no screws or the like for connecting pulse motor 130, following pulley 705 and driving pulley 711 or tension belt 708 to frame plate 700 for driving carriage 118 as compared to prior art printers.

It will thus be seen that the objects set forth above, and those made apparent from the preceding description, are efficiently attained and, since certain changes may be made in the above method and construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language, might be said to fall therebetween.

What is claimed is:

1. A printer comprising:

a platen;

plate means for exerting different levels of pressure against the platen and including a first plate facing the platen and a second plate disposed adjacent to the first plate;

release assembly means for controlling the level of pressure exerted by the plate means against the platen and including shaft means having at least one protrusion extending along the length of the shaft means for pressing against the second plate and control means for controlling the position of the shaft means relative to the plate means;

said control means including release lever means and intermediate lever means, said intermediate lever means coupled to the shaft means; and a frame;

wherein said intermediate lever means includes projection means for securing the intermediate lever means to the frame and, wherein the projection means includes claw means and the frame includes a hole, said claw means operable for being pushed through the hole and, once beyond the hole, locking itself to the frame.

2. The printer of claim 1, further including a frame having window means and wherein the release lever means has extension means extending through said window means for limiting the movement of said release lever means.

3. The printer of claim 1, wherein each protrusion is disposed at a predetermined location along the width of the shaft means and has a height which is greater than the perpendicular distance therefrom to the edge of the shaft means as measured along the width of the shaft means.

4. The printer of claim 1, further including pressing roller means for pressing against the platen and wherein the release lever means includes means for controlling the position of the pressing roller means relative to the platen.

5. The printer of claim 4, further including a roller shaft about which the pressing roller means rotates; and wherein one end of the roller shaft extends within the means for controlling the position of the pressing roller means and wherein the release lever means includes means for receiving a portion of the frame to permit the release lever means to pivot to a first position which allows the pressing roller means to press against the platen and to a second position which forces the pressing roller means to become separated from the platen.

6. The printer of claim 5, further including spring means for biasing the pressing roller means towards the platen.

7. The printer of claim 1 in combination with a recording medium wherein the first plate is made from a material having a coefficient of friction less than the coefficient of friction of the recording medium so that the recording medium can slide against the first plate.

8. The printer of claim 1, wherein the second plate is made from a material having spring-like properties.

9. The printer of claim 1, wherein the first plate and second plate each have a plurality of openings extending along the length of each plate.

10. The printer of claim 9, further including a frame having a plurality of projection means protruding therefrom and extending through the corresponding plurality of openings of each plate to provide a fulcrum about which the plates pivot.

11. A printer comprising:

a platen;

plate means for exerting different levels of pressure against the platen and including a first plate facing the platen and a second plate disposed adjacent to the first plate;

release assembly means for controlling the level of pressure exerted by the plate means against the platen and including shaft means having at least one protrusion extending along the length of the shaft means for pressing against the second plate and control means for controlling the position of the shaft means relative to the plate means;

said control means including release lever means and intermediate lever means, said release lever means slidably coupled to said intermediate lever means and including indentation means; and a frame having pin means, said indentation means operable for receiving said pin means to permit the release lever means to pivot;

wherein said intermediate lever means includes projection means having claw means and the frame includes a hole, said claw means operable for being pushed through the hole and, once beyond the hole, locking itself to the frame.

12. The printer of claim 11, wherein the frame has window means and wherein the release lever means has extension means extending through said window means for limiting the movement of said release lever means.

* * * * *